US009115875B2

(12) United States Patent
Su et al.

(10) Patent No.: US 9,115,875 B2
(45) Date of Patent: Aug. 25, 2015

(54) LED LIGHT LAMPS USING STACK EFFECT FOR IMPROVING HEAT DISSIPATION

(71) Applicants: Huga Optotech Inc., Taichung (TW); Interlight Optotech Corporation, Yangmei (TW)

(72) Inventors: Hwa Su, Yangmei (TW); Tzu-Chi Cheng, Yangmei (TW); Hong-Zhi Liu, Yangmei (TW); Yu-Min Li, Yangmei (TW)

(73) Assignees: Huga Optotech Inc., Taichung (TW); Interlight Optotech Corporation, Yangmei, Taoyuan County (TW)

( * ) Notice: Subject to any disclaimer, the term of this patent is extended or adjusted under 35 U.S.C. 154(b) by 0 days.

(21) Appl. No.: 14/309,750

(22) Filed: Jun. 19, 2014

(65) Prior Publication Data

US 2014/0375201 A1 Dec. 25, 2014

Related U.S. Application Data

(60) Provisional application No. 61/837,935, filed on Jun. 21, 2013.

(51) Int. Cl.

| | |
|---|---|
| ***H01J 61/52*** | (2006.01) |
| ***F21V 29/00*** | (2015.01) |
| ***F21K 99/00*** | (2010.01) |
| ***F21V 29/83*** | (2015.01) |
| *F21Y 103/00* | (2006.01) |
| *F21V 3/00* | (2015.01) |
| *F21Y 101/02* | (2006.01) |
| *F21V 29/506* | (2015.01) |

(52) U.S. Cl.

CPC ..... *F21V 29/004* (2013.01); *F21K 9/135* (2013.01); *F21V 29/83* (2015.01); *F21V 3/00* (2013.01); *F21V 29/506* (2015.01); *F21Y 2101/02* (2013.01); *F21Y 2103/003* (2013.01)

(58) Field of Classification Search

CPC ..... H01L 21/67115
USPC ..... 313/25, 24, 17, 12, 35
See application file for complete search history.

(56) References Cited

U.S. PATENT DOCUMENTS 4,490,649 A * 12/1984 Wang ..... 315/50
4,625,141 A * 11/1986 Keeffe et al. ..... 313/25

* cited by examiner

*Primary Examiner* — Vip Patel
(74) *Attorney, Agent, or Firm* — Muncy, Geissler, Olds & Lowe, P.C.

(57) ABSTRACT

A light-emitting lamp has a bulb shell, a convective accelerator, a light-emitting filament and a bulb base. The bulb shell defines an interior volume filled with a filling gas, and comprises a first transparent material. The convective accelerator is disposed within the interior volume, and comprises a second transparent material. The convective accelerator contains a flue with first and second openings. The light-emitting filament is disposed within the flue, comprising a plurality of semiconductor light-emitting elements. When the light-emitting filament emits light to generate heat, the flue allows a convection flow of the filling gas to pass into one of the first and second openings. The bulb base supports the bulb shell and the light-emitting filament, and has electrical conductors in electrical communication with the light-emitting filament. The first and the second openings have different distances apart from the bulb base.

20 Claims, 5 Drawing Sheets

LED LIGHT LAMPS USING STACK EFFECT FOR IMPROVING HEAT DISSIPATION

CROSS-REFERENCE TO RELATED APPLICATION

This application claims priority to and the benefit of Provisional Application Ser. No. 61/837,935 filed on Jun. 21, 2013, which is incorporated by reference in its entirety.

DESCRIPTION OF BACKGROUND ART

The present disclosure relates generally to LED light lamps, more particularly to LED light lamps as replacements for incandescent bulbs or compact fluorescent light bulbs.

Incandescent light bulbs are commonly used in many environments, such as households, commercial buildings, and advertisement lighting, and in many types of fixtures, such as desk lamps and overhead fixtures. Incandescent light bulbs can each have a threaded electrical connector for use in Edison-type fixtures, though incandescent bulbs can include other types of electrical connectors such as a bayonet connector or pin connector. Incandescent light bulbs generally consume large amounts of energy and have short life-spans. Many countries have begun phasing out or plan to phase out the use of incandescent light bulbs entirely.

Compact fluorescent light bulbs (CFLs) have been gaining popularity as replacements for incandescent light bulbs. CFLs are typically much more energy efficient than incandescent light bulbs, and CFLs typically have much longer life spans than incandescent light bulbs. However, CFLs contain mercury, a toxic chemical, which makes disposal of CFLs difficult. Additionally, CFLs require a momentary startup period before producing light, and many consumers do not find CFLs capable of producing light of similar quality to incandescent bulbs. Further, CFLs are often larger than incandescent lights of similar luminosity.

LED light lamps have been developed as an alternative to both incandescent light bulbs and CFLs. These LED light lamps each typically include a base, a group of LEDs attached to the base, and a bulb. The base normally has a structure of fins as a heat sink, and an electrical connector, such as an Edison screw base, at one end. The bulb often has a semicircular shape with its widest portion attached to the base such that the bulb protects the LEDs.

The structure of fins complicates the design of an LED light lamp, though. The structure of fins could shadow the proximity of the base from the light emitted from the LEDs, making the luminous distribution of the LED light lamp very different from that of an incandescent light bulb. The other solution of improving heat dissipation is using metal column extending from the base toward the center of the bulb. LEDs are mounted on the lateral surface of the metal column, which serves both as a heat path between the LEDs and the base, as well as a way to elevate the LEDs for an omnidirectional light pattern. This metal column is costly, however, in view of component cost and assembling process.

SUMMARY OF THE DISCLOSURE

The present disclosure a light-emitting lamp has a bulb shell, a convective accelerator, a light-emitting filament and a bulb base. The bulb shell defines an interior volume filled with a filling gas, and includes a first transparent material. The convective accelerator is disposed within the interior volume, and includes a second transparent material. The convective accelerator contains a flue with first and second openings. The light-emitting filament is disposed within the flue, comprising a plurality of semiconductor light-emitting elements. When the light-emitting filament emits light to generate heat, the flue allows a convection flow of the filling gas to pass into one of the first and second openings. The bulb base supports the bulb shell and the light-emitting filament, and has electrical conductors in electrical communication with the light-emitting filament. The first and the second openings have different distances apart from the bulb base.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified. These drawings are not necessarily drawn to scale. Likewise, the relative sizes of elements illustrated by the drawings may differ from the relative sizes depicted.

The invention can be more fully understood by the subsequent detailed description and examples with references made to the accompanying drawings, wherein.

DETAILED DESCRIPTION OF PREFERRED EMBODIMENTS

Some embodiments of this disclosure provide an LED light lamp in which stack effect enhances heat convection to improve heat dissipation when the LED filament in the LED light lamp emits light. The LED light lamp is a kind of light-emitting lamp, including a bulb shell, a convective accelerator, an LED filament, and a bulb base. The bulb shell is capable of transmitting at least a portion of light in the visible spectrum, and defines an interior volume within which the convective accelerator is disposed. The convective accelerator has a flue, and is also capable of transmitting at least a portion of light in the visible spectrum. The bulb base supports the bulb shell and is in electrical communication with the LED filament disposed within the flue. A filling gas fills the interior volume. When the LED light lamp stands upright with the bulb base fixed on a horizontal plane, the flue is in parallel to a vertical line, having a topmost opening and a bottom opening. When the LED filament emits light and heats the filling gas inside the flue, filling gas rises up to exit through the topmost opening of the flue. At the same time, due to the reduced pressure in the bottom opening, it draws in the filling gas which has been cooled down by the bulb shell. In other words, the convective accelerator uses the flue to provide stack effect, also referred to as chimney effect, so as to allow a convective flow going through the flue and circulating within the interior volume. The convective flow could quickly carry away the heat from the LED filament to the bulb shell and/or the bulb base, which dissipate heat into the ambient air.

Figure 1:
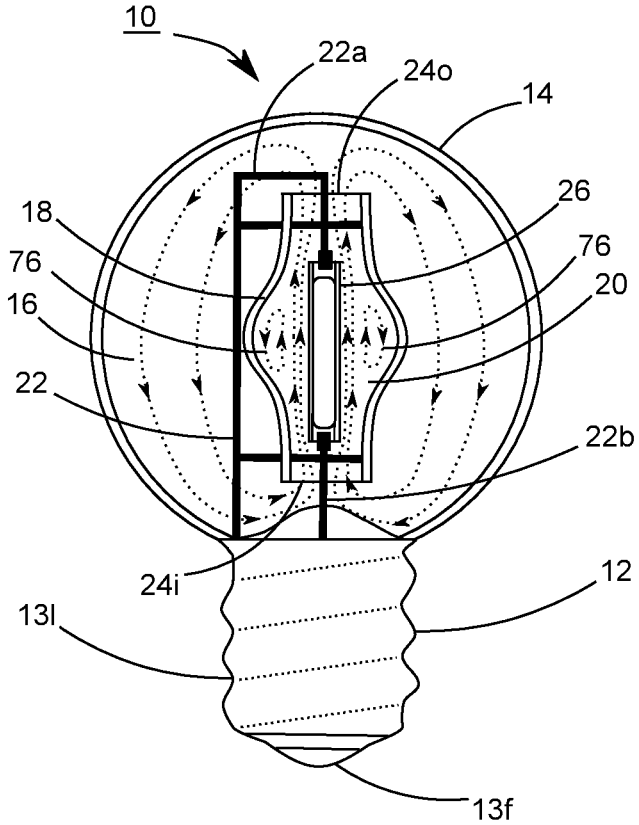
FIG. 1 demonstrates an LED light lamp according to embodiments of the disclosure.

FIG. 1 demonstrates an LED light lamp 10 according to embodiments of the disclosure. The LED light lamp 10, a light-emitting lamp, has a bulb shell 14 and bulb base 12 in appearance. The bulb base 12 supports and connects the bulb shell 14 that defines an interior volume 16 filled with a filling gas. A brace structure 22 includes two parts 22*a* and 22*b*, each extending from the bulb base 12. The parts 22*a* and 22*b* each contain beams to hold a convective accelerator 18 within the interior volume 16. The convective accelerator 18 contains a flue 20 with two openings at two opposite ends, where the opening closest to the bulb base 12 is referred hereinafter to as the bottom opening 24*i* and the other close to the top of the bulb shell 14 the topmost opening 24*o*. As shown in FIG. 1, parts 22*a* and 22*b* extend through the topmost opening 240 and the bottom opening 24*i* respectively. In FIG. 1, the beams of the brace structure 22 contact both the inner and outer sidewalls of the convective accelerator 18, holding it upright like a chimney within the interior volume 16. Disposed within the flue 20 is also a LED filament 26, which is an example of a light-emitting filament and has two electrodes contacted and supported by the parts 22*a* and 22*b*. The brace structure 22, while holding both the LED filament 26 and the convective accelerator 18 within the interior volume 16, has an electrically conductive material to provide electrical communication between the LED filament 26 and the bulb base 12. The bulb base 12 could have a power supply or a power regulator to supply regulated voltage or current to the LED filament 26, which accordingly emits light transmitting through the convective accelerator 18 and the bulb shell 14.

In one embodiment, the bulb base 12 is a threaded screw base with a screw axis, and both the bulb shell 14 and the convective accelerator 18 are rotationally symmetric along the screw axis. Shown in FIG. 1, the bulb base 12 is basically a cylinder base with an axis and the flue is positioned substantially along the axis. The bulb base 12 has a lateral contact 131 and a foot contact 13*f* for screwing into a matching threaded socket and forming electrical contacts. If the LED filament 26 emits light in all direction, the LED light lamp 10 could be an omnidirectional light fixture.

The convective accelerator 18 helps provide stack effect. When the LED filament 26 is powered to emit light, the heat generated from the LED filament 26 warms up the filling gas within the flue 20, such that the filling gas inside the flue 20 is less dense than that outside the flue 20. If the LED light lamp 10 is mounted upright on a horizontal plane, the warmer filling gas inside the flue 20 floats out the topmost opening 24*o*, being replaced with the cooler filling gas from the bottom opening 24*i*. The warmer filling gas vented from the topmost opening 240 can be cooled down by the bulb shell 14, and descends toward to the bulb base 12 and the bottom opening 24*i*. In this way, it forms a cycle of heat convection. In other words, a convective flow of the filling gas initiates from the space inside the flue 20 around the LED filament 26, exits at the topmost opening 240, descends through the space between the convective accelerator 18 and the bulb shell 14, passes into the bottom opening 24*i*, and returns back into the flue 20, as demonstrated by the streamlines of the filling gas in FIG. 1. The convective flow is accelerated inside the convective accelerator 18 as the streamlines are closer to each other inside the convective accelerator 18 than those outside the convective accelerator 18, meaning the filling gas inside the convective accelerator 18 flows quicker. This convective flow enhanced by the convective accelerator 18 carries the heat of the LED filament 26 away to the ambient air of the LED light lamp 10 much more efficiently, resulting in a cooler LED light lamp with a longer life span.

Stack effect still works if the LED light lamp 10 is mounted upside-down on a ceiling, but the convective flow shown in FIG. 1 reverses.

The bulb shell 14 and the convective accelerator 18 could contain any material adapted to transmit at least a portion of light in the visible spectrum. They might comprise the same transparent material or they might have different transparent materials. For example, both the bulb shell 14 and the convective accelerator 18 are made of quartz glass.

It should be noted that in FIG. 1 the LED filament 26 is elevated to a place high above the bulb base 12, which, accordingly, blocks less light emitted from the LED filament 26 from reaching the area around the bulb base 12. The luminous distribution of the LED light lamp 10 in FIG. 1 could be intensified for the view angle close to the proximity of the bulb base 12, to be similar with that of a conventional incandescent light bulb.

The filling gas inside the bulb shell 14 preferably has a less molecular mass and/or a higher convective heat transfer coefficient in comparison with the ambient air around the LED light lamp 10. In one embodiment, the filling gas is substantially sealed by the bulb shell 14 and the bulb base 12. For example, the filling gas could be inert gas, hydrogen, nitrogen, or any combination thereof. Depending on the hardness and strength of the bulb shell 14, the pressure of the filling gas is preferably within a range from 0.8 atm to 1.3 atm.

In FIG. 1, the brace structure 22 conducts electric current, and at the same time fixes the LED filament 26 and the convective accelerator 18 inside the bulb shell 14. Metals, alloys and metal compounds are all material candidates to construct the brace structure 22. Material of the brace structure 22 preferably has high thermal conductivity, so as to quickly conduct the heat of the LED filament 26 to the space between the bulb shell 14 and the convective accelerator 18 where the filling gas is cooler. For instance, the brace structure 22 contains Dumet wire, which is essentially a nickel-iron wire with a coating of copper. The core wire and copper cladding of Dument wire are bonded together metallurgically so that the composite wire has a continuous metal structure.

Figure 2A:
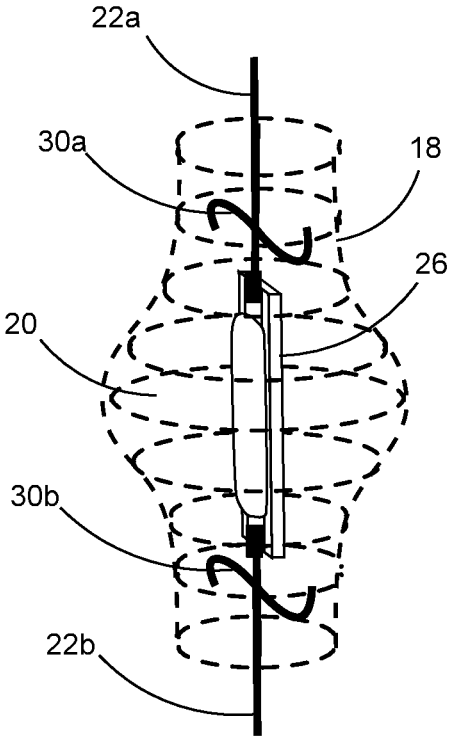
FIG. 2A shows the LED filament supported by a portion of the brace structure inside the flue.
Figure 2B:
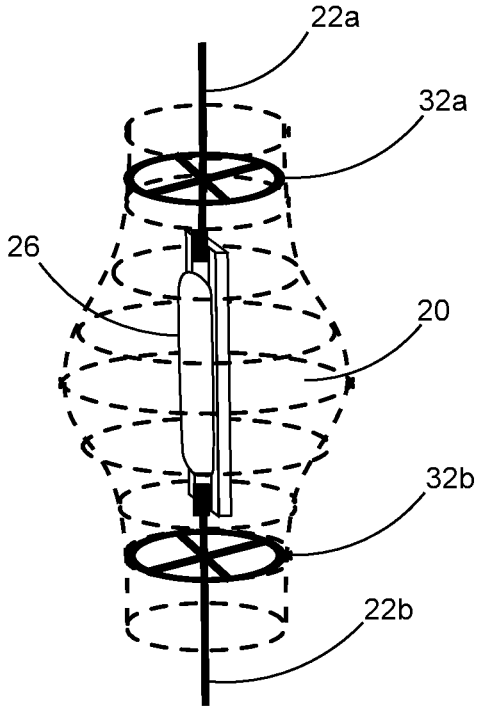
FIG. 2B shows another kind of the brace structure supporting both the LED filament and the convective accelerator within the interior volume.

FIG. 2A shows the LED filament 26 supported by a portion of the brace structure 22 inside the flue 20. The part 22*a* has a column contacting one end of the LED filament 26. Two beams 30*a* laterally and radially extend from the column, and each has a curved end portion against the inner sidewall of the convective accelerator 18, whose contour is shown by dashed line in FIG. 2A. Similar with the part 22*a*, the part 22*b* below the LED filament 26 forms electric contact at the other end of the LED filament 26, and has two beams 30*b* each having a curved end portion against the inner sidewall of the convective accelerator 18. Therefore, the convective accelerator 18 is supported by the parts 22*a* and 22*b* within the interior volume 16. FIG. 2B shows another kind of the brace structure 22 supporting both the LED filament 26 and the convective accelerator 18 within the interior volume 16. Each of the parts

22*a* and 22*b* in FIG. 2B has a fixing ring (32*a* or 32*b*), which is supported by beams to prop against the inner sidewall of the convective accelerator 18.

The LED filament 26 could be an elongated LED chip fabricated by wafer processes to have one or more light-emitting stacks and at least two pads on a substrate, wherein the light-emitting stack includes a first semiconductor layer, an active layer, and a second semiconductor layer. The material of the first semiconductor layer, the active layer, and the second semiconductor layer may be III-V compound, such as AlxInyGa(1−x−y)N or AlxInyGa(1−x−y)P, 0≤x, y≤1; (x+y)≤1. The pads are for forming electric contact with the parts 22A and 22B of the brace structure 22. In another embodiment, the LED filament 26 is an LED assembly with a transparent or translucent mount, and several LED chips mounted on the mount. Bonding wires for example provide electric interconnection between the LED chips. Formed on a surface of the mount are conductive electrodes, capable of forming electric contact with the parts 22*a* and 22*b* of the brace structure 22 to supply power for driving the LED chips on the mount. The LED chips in the LED filament 26 could emit ultraviolet, blue, red, or green light, and they are not necessary to emit the same color light. In some embodiments, the LED chips in the LED filament 26 are substantially encapsulated by a silicone capsule with phosphor dispersed therein. All the LED chips in the LED filament 26 are examples of semiconductor light-emitting elements fabricated by wafer processes.

The forward voltage of the LED filament 26 could be lower than 5V, the same as the forward voltage of a single LED chip fabricated by wafer processes. It could be as high as about 40V, though, meaning several light-emitting stacks are in series connected electrically between the two electrodes of the LED filament 26.

An LED chip on the LED filament 26 might be DC or AC LED chip. A DC LED chip refers to an LED chip designed to be driven by a direct-current (DC) power source, which might be a rectified one from an AC power source. The several light-emitting stacks in a DC LED chip are commonly, but not limited to, connected in series. Similarly, an AC LED chip refers to an LED chip having several light-emitting stacks formed a specific array in order to be operated by an alternative power source directly. Electric interconnection between the light-emitting stacks is normally provided by one or more conductive connectors above a layer of electric insulation which covers a portion of the light-emitting stacks fabricated by wafer process. Depending whether a DC or AC power source is required for driving it, the LED filament 26 could be a DC or AC LED filament.

Figure 3A:
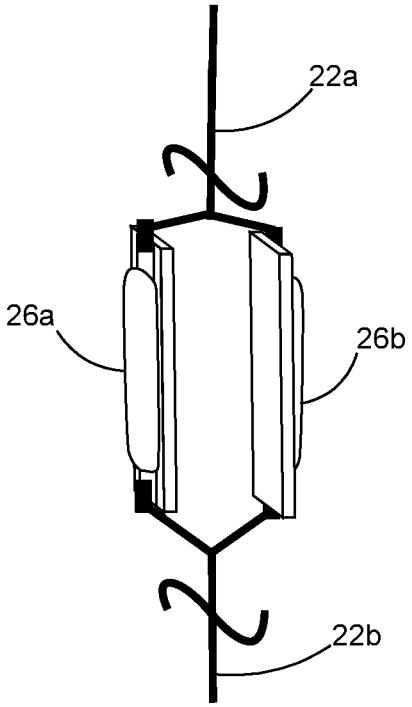
FIG. 3A demonstrates LED filaments electrically connected in parallel, while FIG. 3B demonstrates LED filaments electrically connected in series.
Figure 3B:
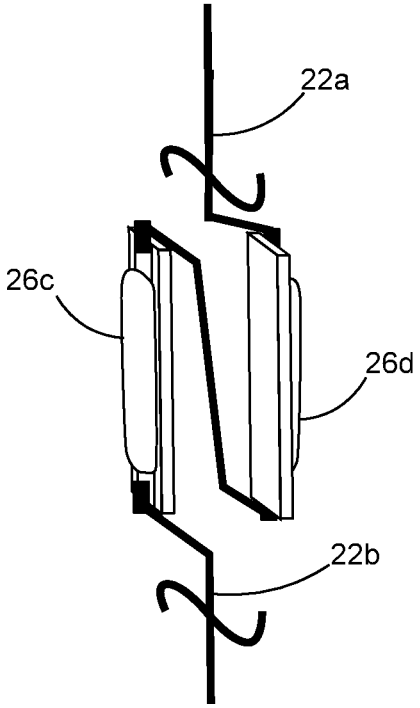
FIG. 3C demonstrates LED filaments sandwiching a metal net, and FIG. 3D demonstrates a metal section crosslinking LED filaments.
Figure 3C:
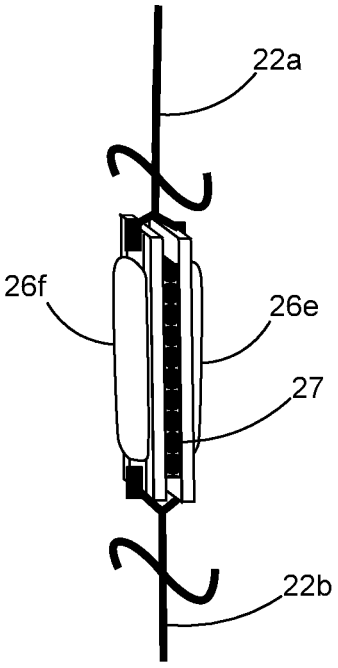
Figure 3D:
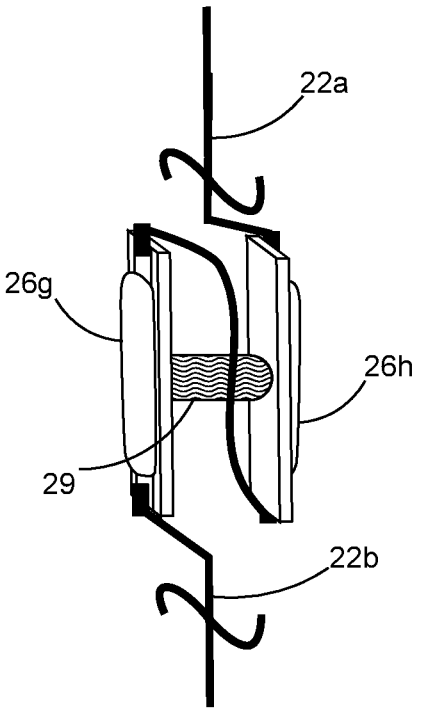

An LED light lamp according to the disclosure might have more than one LED filaments within one flue, as exemplified in FIGS. 3A and 3B. FIG. 3A demonstrates LED filaments 26*a* and 26*b* electrically connected in parallel, while FIG. 3B demonstrates LED filaments 26*c* and 26*d* electrically connected in series. Dumet wire could be used for the electric interconnection between the LED filaments within the flue 20. Preferably, adhesive may be added between the LED filaments to join them together. Material of the adhesive preferably has high thermal conductivity to quickly extract heat from the LED filaments. The adhesive might have porous structure, netlike, or beamlike that the convective flow of the filling gas can go through or around to cool down the adhesive efficiently. In some embodiments, the adhesive is a thermal conductive cross linking structure put between the backsides of the LED filaments in FIG. 3A or 3B, for both fixing their positions and enhancing the heat dissipation. In another embodiment, a piece of a metal net 27 shown in FIG. 3C coated with an adhesive layer could be sandwiched between the backsides of the LED filaments 26*f* and 26*e* so as to join them together. This kind of adhesive could be added between the LED filaments in FIG. 3A or 3B as well, to prevent them from departing and enhance thermal dissipation. FIG. 3D demonstrates a metal section 29 positioned to crosslink LED filaments 26*g* and 26*h*. The metal section 29 could be rigid but porous, and contacts centers of the backsides of the LED filaments 26*g* and 26*h* where are supposed to be hottest when the LED filaments 26*g* and 26*h* emit light. Having excellent thermal conductivity, the metal section 29 could extract heat from the backsides, and dissipate the heat to the convective flow passing by, so as to cool down the LED filaments 26*g* and 26*h* effectively. The metal section 29 also provides structural reinforcement to further fix the LED filaments 26*g* and 26*h* together as a whole.

Figure 4A:
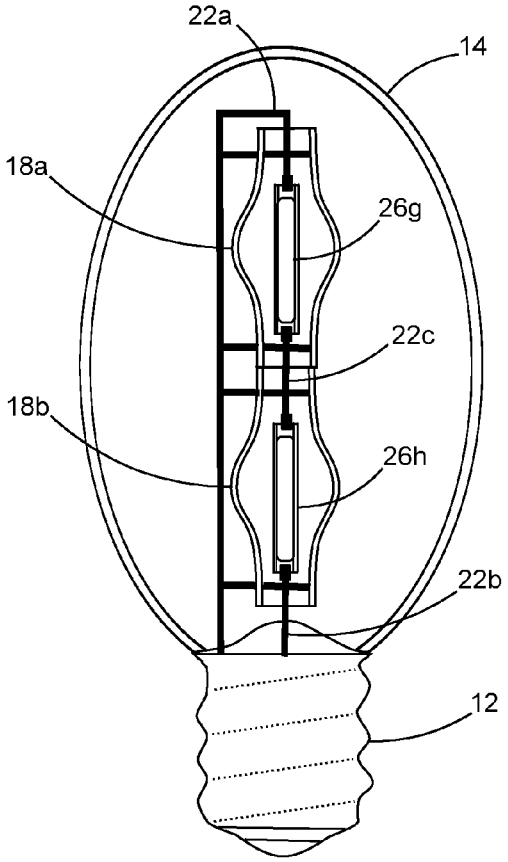
FIG. 4A demonstrates an LED light lamp with two convective accelerators.
Figure 4B:
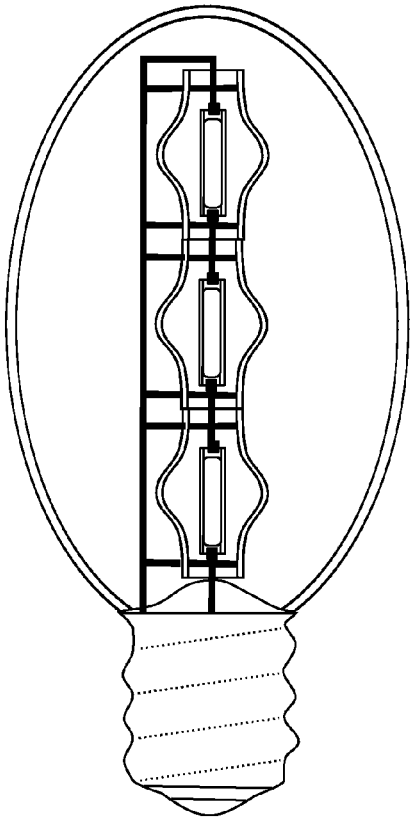
FIG. 4B demonstrates an LED light lamp 10B with a stack of three convective accelerators.

This invention is not limited to an LED light lamp with mere one convective accelerator, nevertheless. FIG. 4A demonstrates an LED light lamp with two convective accelerators 18*a* and 18*b*, where the bottom opening of the convective accelerator 18*a* is in close proximity of the topmost opening of the convective accelerator 18*b*. In other words, the convective accelerator 18*a* stands on the convective accelerator 18*b*. The brace structure 22 in FIG. 4A further has a part 22*c* to support both the convective accelerators 18*a* and 18*b* and to provide electric communication between the LED filaments 26*g* and 26*h*. FIG. 4B demonstrates an LED light lamp 10B with a stack of three convective accelerators, whose detail is omitted herein because FIG. 4B is self-explanatory according to the aforementioned teaching.

Figure 5A:
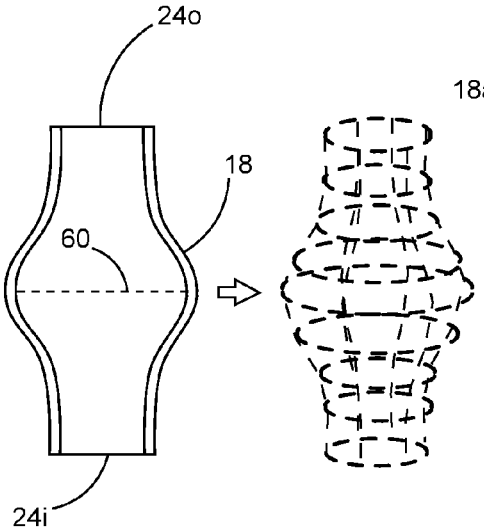
FIG. 5A shows a side view and contours of the convective accelerator.

FIG. 5A shows a side view and contours of the convective accelerator 18 in FIG. 1. The convective accelerator 18 in FIG. 5A is basically a cylinder with an enlarged midsection to adapt an LED filament. Both the topmost opening 24*o* and the bottom opening 24*i* are smaller than a hole 60 in a cross sectional view of the enlarged midsection. Shown in FIGS. 1 and 5, the streamlines close to the enlarged midsection inside the convective accelerator 18 form close loops 76 to provide internal heat convection transfer from the LED filament to the convective accelerator 18. The concave shape of the enlarged midsection could further provide better heat radiation to transfer heat to ambient air. Accordingly, the LED light lamp 10 with the convective accelerator 18 could dissipate heat quicker than a conventional LED light lamp.

Figure 5B:
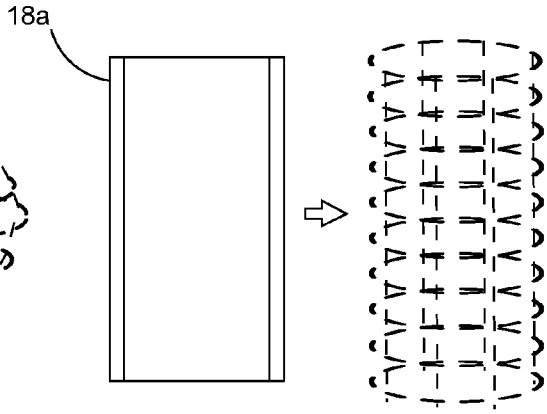
FIGS. 5B, 5C, 5D, 5E and 5F show side views and contours of alternative convective accelerators.
Figure 5C:
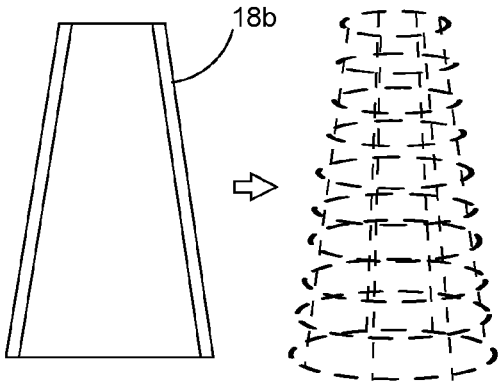
Figure 5D:
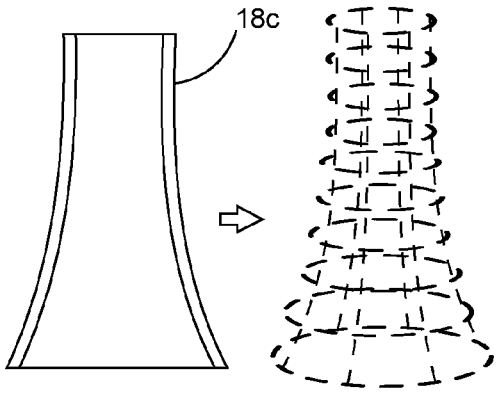
Figure 5E:
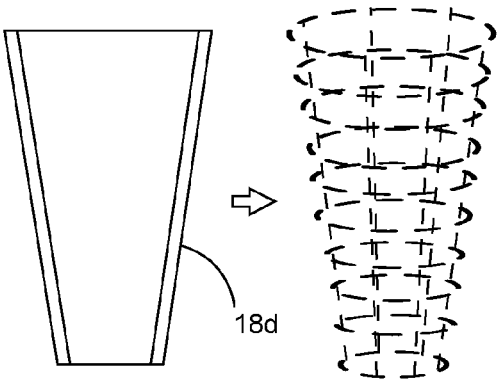
Figure 5F:
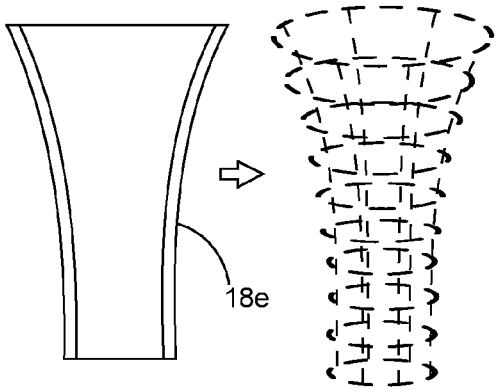

The shape of the convective accelerator 18 in FIG. 1 is not intended to limit the scope of the invention, however. FIGS. 5B, 5C, 5D, 5E and 5F show side views and contours of alternative convective accelerators. The convective accelerator 18*a* in FIG. 5B is a hollow cylinder, where the topmost and bottom openings are of the same size. The convective accelerator 18*b* in FIG. 5C is a hollow frustum of a cone, whose topmost opening is smaller than its bottom opening. The convective accelerator 18*c* in FIG. 5D is also a hollow frustum, but it is of a concave cone. The convective accelerators 18*d* and 18*e* in FIGS. 5E and 5F are upside-down versions of the convective accelerators in FIGS. 5C and 5D, respectively. The shape of the convective accelerators in FIG. 5E is a funnel, while that in FIG. 5F is an inverted hollow frustum of a concave cone. In some other embodiments, a convective accelerator could be an inverted or non-inverted hollow pyramid.

In one embodiment, at least one of the bulb shell 14, the convective accelerator 18 and the LED filament 26 of FIG. 1 preferably has a radiative heat dissipation layer to strongly emit thermal radiation, for example, Far Infrared Radiative film. This radiative heat dissipation layer might be formed by coating a radiative heat dissipation paste or laminating a radiative heat dissipation film on a backside of the LED filament 26, the inner or outer sidewall of the convective accelerator 18, or the inner or outer surface of the bulb shell 14. For example, the radiative heat dissipation layer has a microscopic structure with crystal, which has a grain size between one nanometer and tens of micrometers. The crystal formed in the radiative heat dissipation layer could induce some specific lattice resonance to strongly emit corresponding thermal radiation, such as infrared or far infrared. The surface of the radiative heat dissipation layer could be roughened in order to have a larger surface area for thermal radiation. Accordingly, the radiative heat dissipation layer provides strong thermal radiation and could enhance the rate of heat transfer from the LED light lamp 10 to ambient air.

Figure 6:
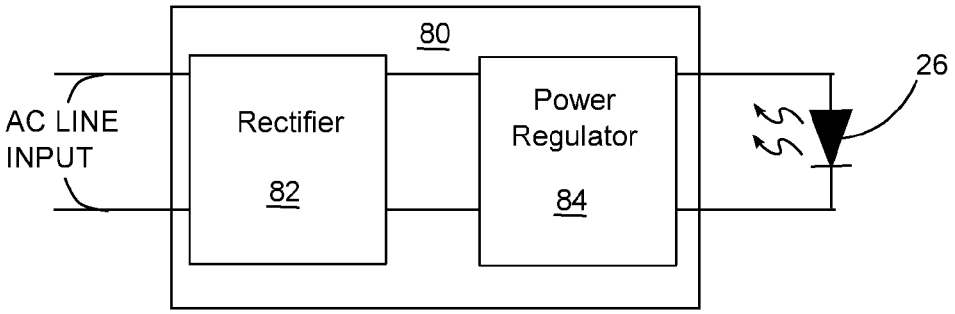
FIG. 6 shows a power supply put inside the bulb base of FIG. 1.

The bulb base 12 in FIG. 1 could function as a housing to accommodate a power supply. FIG. 6 shows a power supply 80 put inside the bulb base 12 of FIG. 1, in case that the LED filament 26 is a DC LED filament. The power supply 80 has two AC line input nodes electrically connected to the foot contact 13*f* and the lateral contact 131 respectively, to receive electric power from a matching base socket for example. The power supply 80 further includes a rectifier 82 and a power regulator 84. The rectifier 82 could be a bridge rectifier for converting the AC input across the two AC line input nodes into a DC output, to power the power regulator 84. The power regulator 84 could be a switching mode power supply for supplying a regulated current to the LED filament 26. In some low-cost embodiments, the power regulator 84 could be simply a mere resistor to roughly limit the current through the LED filament 26. In case that the LED filament 26 is an AC LED filament, the power supply 80 might be unnecessary and be omitted such that the LED filament 26 can be directly driven by the AC input across the foot contact 13*f* and the lateral contact 131. Alternatively, the power supply 80 could be a mere resistor connected in series with the LED filament 26 between the AC input nodes if the LED filament 26 is an AC LED filament.

Presence of the convective accelerator 18 in FIG. 1 provides stack effect to enhance a convective flow, which carries the heat of the LED filament 26 in an effective way to dissipate through the bulb shell 14. The temperature increment of the LED filament 26 when emitting light might be well controlled. As the temperature of the LED filament is a key issue to the color temperature and the lifespan of a LED light lamp, embodiments of the disclosure could be good solutions to cool down LED light lamps. The cost of an LED light lamp might be reduced by sparing the conventional heat sink with fins when a convective accelerator according the embodiment is present. Furthermore, like a conventional incandescent light bulb whose filament rests at about the center of a bulb shell, the LED filament 26 in FIG. 1 also rests at about the center of the bulb shell 14. If the LED filament 26 emits light in all directions, the LED light lamp 10 in FIG. 1 could have a luminous intensity distribution comparable with that of a conventional incandescent light bulb. Therefore, the LED light lamps according to the embodiments in this disclosure could replace incandescent bulbs or CFLs.

Figure 7A:
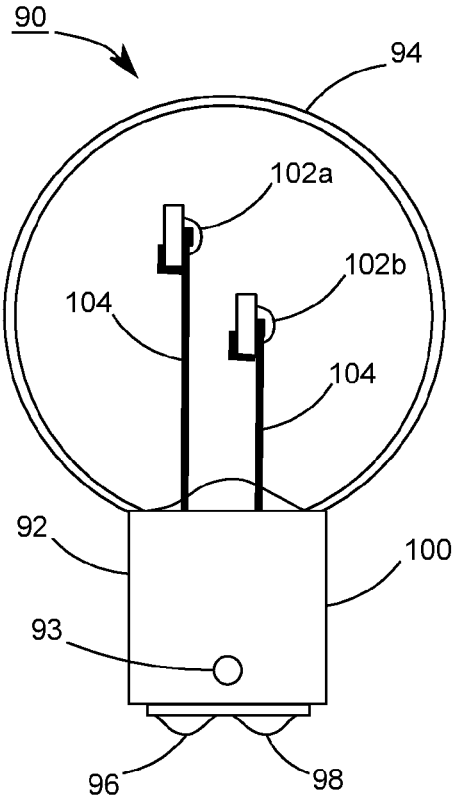
FIGS. 7A and 7B demonstrate two cross sectional views of an LED light lamp according to embodiments of the disclosure.
Figure 7B:
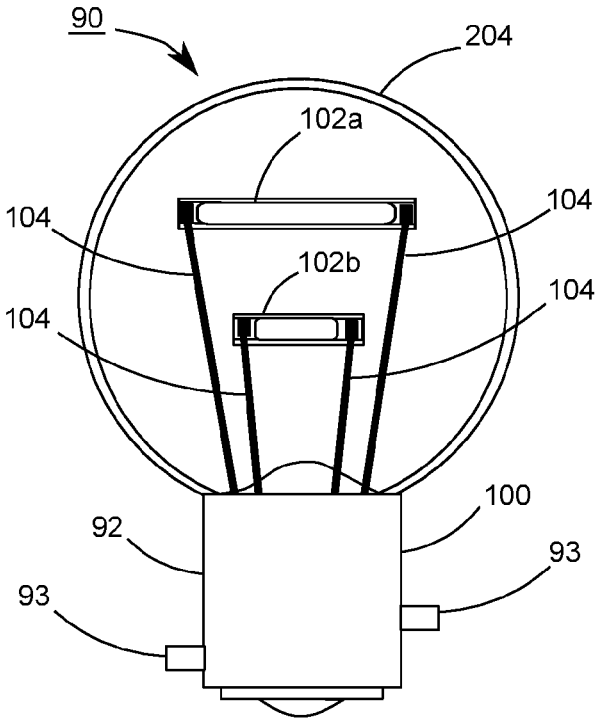

FIGS. 7A and 7B demonstrate two cross sectional views of an LED light lamps 90 according to embodiments of the disclosure. The LED light lamps 90 has a bayonet base 92 supporting a bulb shell 94 and 204, and the bayonet base 92 includes two foot contacts (96 and 98) and a lateral contact 100. Two radial pins 93 extend from the lateral contact 100. The cutting planes for generating the cross sectional views of FIGS. 7A and 7B are perpendicular to each other, and intersect in the axis of the bayonet base 92. Disposed inside the LED light lamp 90 are two LED filaments 102*a* and 102*b*, each gripped by a pair of braces 104 extending from the bayonet base 92. These braces 104 could be Dumet wire, for example. The LED filaments 102*a* and 102*b*, as shown in FIG. 7B, are arranged to be parallel to each other, and perpendicular to the axis of the bayonet base 92. The locations of the LED filaments 102*a* and 102*b* differ though in the distance apart from the bayonet base 92, where the LED filament 102*b* is closer to the bayonet base 92 than the LED filament 102*a*. The colors, the color temperatures, and the luminous powers of the lights respectively emitted from the LED filaments 102*a* and 102*b* might be the same or different. The bayonet base 92 could accommodate a power supply for providing electric power to properly drive the LED filaments 102*a* and 102*b* through the braces 104. For instant, a DC power source connected to the foot contact 96 causes only the LED filament 102*a* emitting light, and another DC power source connected to the foot contact 98 does only the LED filament 102*b* emitting light.

In some embodiments, the LED filaments 102*a* and 102*b* individually emit light with different luminous powers when properly powered. For example, in case that the LED light lamp 90 is the light source of a brake lamp in a vehicle, only the LED filaments 102*a* emits light of 40 lumen when the vehicle is moving freely, and the LED filaments 102*b* joins to increase the light by 300 lumen when the vehicle slows down due to the activation of a brake.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A light-emitting lamp, comprising:

a bulb shell, defining an interior volume filled with a filling gas, the bulb shell comprising a first transparent material;

a convective accelerator, disposed within the interior volume, comprising a second transparent material, and containing a flue with first and second openings;

a light-emitting filament, disposed within the flue, comprising a plurality of semiconductor light-emitting elements, wherein when the light-emitting filament emits light to generate heat, the flue allows a convection flow of the filling gas to pass into one of the first and second openings; and a bulb base, supporting the bulb shell and the light-emitting filament, and having electrical conductors in electrical communication with the light-emitting filament, wherein the first and the second openings have different distances apart from the bulb base.

2. The light-emitting lamp as claimed in claim 1, wherein the bulb base is a cylinder base with an axis, and the flue is positioned substantially along the axis.

3. The light-emitting lamp as claimed in claim 1, comprising a brace structure holding the convective accelerator within the interior volume, wherein the brace structure further provides electrical communication between the light-emitting filament and the bulb base.

4. The light-emitting lamp as claimed in claim 3, wherein the convective accelerator has an inner sidewall, and the brace structure comprises a beam against the inner sidewall to support the convective accelerator.

5. The light-emitting lamp as claimed in claim 3, where the brace structure comprises a fixing ring to prop again an inner sidewall of the convective accelerator.

6. The light-emitting lamp as claimed in claim 1, comprising a brace structure holding the light-emitting filament within the flue.

7. The light-emitting lamp as claimed in claim 1, comprising more than one light-emitting filament electrically connected in series within the convective accelerator.

8. The light-emitting lamp as claimed in claim 1, comprising more than one light-emitting filament electrically connected in parallel within the convective accelerator.

9. The light-emitting lamp as claimed in claim 1, wherein the convective accelerator has a midsection between the first and second openings, and a cross sectional view of the midsection has a hole larger than the first and second openings.

10. The light-emitting lamp as claimed in claim 1, wherein the convective accelerator is a hollow cylinder.

11. The light-emitting lamp as claimed in claim 1, wherein the convective accelerator is a hollow frustum.

12. The light-emitting lamp as claimed in claim 11, wherein the convective accelerator is a hollow frustum of a concave cone.

13. The light-emitting lamp as claimed in claim 1, wherein the convective accelerator is a funnel.

14. The light-emitting lamp as claimed in claim 13, wherein the funnel is of an inverted concave cone.

15. The light-emitting lamp as claimed in claim 1, wherein the convective accelerator is adapted to transmit at least a portion of light in the visible spectrum.

16. The light-emitting lamp as claimed in claim 1, wherein the filling gas is an inert gas selected from a gas group consisting of noble gases and nitrogen.

17. The light-emitting lamp as claimed in claim 1, wherein the filling gas is substantially sealed by the bulb shell and the bulb base.

18. The light-emitting lamp as claimed in claim 1, wherein the bulb base is an Edison screw base with a foot contact and a lateral contact.

19. The light-emitting lamp as claimed in claim 1, wherein at least one of the bulb shell, the convective accelerator and the LED filament has a radiative heat dissipation film to strongly emit thermal radiation.

20. The light-emitting lamp as claimed in claim 1, further comprising another convective accelerator stacking on the convective accelerator.

* * * * *